US006357631B1

(12) United States Patent
Zaksenberg

(10) Patent No.: US 6,357,631 B1
(45) Date of Patent: Mar. 19, 2002

(54) CONTAINER WITH FORMED MEMORY VALVE

(75) Inventor: Issac Zaksenberg, Scotch Plains, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/543,797

(22) Filed: Apr. 6, 2000

(51) Int. Cl.[7] ..... B65D 37/00
(52) U.S. Cl. ..... 222/212; 222/541.6; 222/215
(58) Field of Search ..... 222/215, 212, 222/206, 153.07, 153.06, 153.05, 541.9, 541.6, 541.5

(56) References Cited

U.S. PATENT DOCUMENTS

| | | | | | |
|---|---|---|---|---|---|
| 2,517,027 | A | * | 8/1950 | Rado | 222/215 |
| 2,904,225 | A | * | 9/1959 | Earles, Jr. | 222/183 |
| 3,278,085 | A | | 10/1966 | Brown | 222/107 |
| 3,635,376 | A | | 1/1972 | Hellstrom | 222/107 |
| 3,913,734 | A | | 10/1975 | Siegel | 206/498 |
| 4,209,096 | A | | 6/1980 | Carkhuff | 222/541.9 |
| 4,218,155 | A | | 8/1980 | Weidner | 222/541.6 |
| 4,252,257 | A | | 2/1981 | Herzig | 222/213 |
| 4,328,912 | A | * | 5/1982 | Haggar et al. | 222/212 |
| 4,792,060 | A | | 12/1988 | Brogli | 222/541.9 |
| 4,921,137 | A | | 5/1990 | Heijenga | 222/107 |
| 5,018,646 | A | | 5/1991 | Billman et al. | 222/107 |
| 5,228,782 | A | | 7/1993 | Imer | 383/200 |
| 5,269,441 | A | * | 12/1993 | O'Meara | 222/94 |
| 5,411,178 | A | * | 5/1995 | Roders et al. | 222/105 |
| 5,839,609 | A | | 11/1998 | Zaksenberg | 222/107 |

FOREIGN PATENT DOCUMENTS

| | | |
|---|---|---|
| EP | 0148118 | 7/1985 |
| EP | 0 726 863 | 12/1998 |
| WO | 95/25051 | 9/1995 |

* cited by examiner

*Primary Examiner*—Kevin Shaver
*Assistant Examiner*—Patrick Buechner
(74) *Attorney, Agent, or Firm*—Michael J. McGreal

(57) ABSTRACT

The container has a varied sized substance body chamber with a channel at an exit end. This channel is sealed by a breakaway tab at an end distant form the chamber. Within the channel is a positive seal valve that can reseal the container after it has initially been opened. This valve is comprised of an upper wall of the channel being in a close contact with the lower wall. The lower wall usually will have a concave shape, with the upper wall contacting the lower wall with a mating convex shape. However this is not required with the channel having many differing shapes and dimensions. This valve can be separated from the substance holding body chamber by a portion of the channel, can be at the junction of the storing chamber and the channel or can be at the junction of the exit of the channel. When a compressive pressure is applied to the substance holding chamber, the substance flows down the channel to the valve. When the liquid pressure reaches a given level, the concave upper wall of the valve moves out of contact with the convex lower wall and some of the substance is dispensed. Upon the cessation of pressure the convex and concave portions come back into contact to cut off the flow of the substance. This valve produces a positive seal which provides a positive seal for the thermoformed container.

22 Claims, 6 Drawing Sheets

CONTAINER WITH FORMED MEMORY VALVE

FIELD OF THE INVENTION

This invention relates to a thermoformed dispensing container that has a positive seal formed memory valve. This invention further relates to a container having a valve comprised of a channel wherein a suckback can be designed into the valve whereby the dispensing container can substantially retain its original shape.

BACKGROUND OF THE INVENTION

The present invention is directed to the problem of sealing a container once it has been opened and a portion of the contents removed. These containers usually are opened by removing a part of the container to expose an opening. This usually is a tear away tab. Upon putting pressure on the main body of the container, some of the contents can be dispensed. The remainder of the contents stay in the container. The present invention provides a positive sealing valve arrangement so that after each dispensing the contents are positively sealed within the body of the container. The valve is comprised of a channel with a unique formed memory valve disposed in the channel.

The thermoformed container in one embodiment also can have a suckback feature. By suckback is meant that after a dispensing of some of the product from the container, air is drawn in through the valve to replace the product that has been dispensed. In this way the container substantially retains it original shape. The degree of suckback will be determined by the rheology of the material being dispensed, the structure of the valve and the resiliency of the material of the container.

Various types of valves for thermoformed containers are known. Such containers with flat channel valves are disclosed in U.S. Pat. No. 3,184,121; U.S. Pat. No. 4,491,157 and U.S. Pat. No. 5,529,224. In FIG. 6 of U.S. Pat. No. 3,184,121 there is shown two parallel flat sheets of material that are opened to dispense a product by a force on the walls of the container. A related valve mechanism is shown in U.S. Pat. No. 4,917,567. FIG. 5C of this patent shows the valve in a dispensing condition. U.S. Pat. No. 5,529,224 is directed to various embodiments of flat channel valves in combination with a thermoformed container. Flat channel valves are well known in the art. However, they have a disadvantage in that they do not provide a positive sealing. Further, the thickness and other characteristics of the thermoformed container materials must be closely designed to provide a reasonably good seal. An improvement over such channel valves is disclosed in U.S. Pat. No. 5,839,609 which discloses a ridge valve arrangement for a channel valve.

Another type of seal is a deformable seal. This is described in U.S. Pat. No. 3,635,376, U.S. Pat. No. 4,928,852 and to an extent in U.S. Pat. No. 5,529,224, FIGS. 26 through 30. In this type of valve one sheet, usually the upper sheet, is designed to have a sufficient integrity to be moved manually from an open position to a closed position. The top sheet is moved manually from an upper position where the valve is open to a lower position where the valve is closed. The manual opening and closing of this type of valve is more clearly shown in FIG. 7 of U.S. Pat. No. 4,928,852.

U.S. Pat. No. 5,839,609 discloses a thermoformed container with a ridge valve. This is a type of a flat channel valve with the integrity of the seal enhanced with depressions on either side of the ridge structure so that the top wall can be drawn downward into a better contact with the ridge by the elasticity of the upper sheet of plastic and the surface tension of the substance being dispensed which is contained in the depressions on either side of the ridge.

Despite the efforts of the inventors of the valve mechanisms of these patents, there has not been achieved a simple, automatic, positive sealing valve for a container. The valves that require manual manipulation require a person to remember to seal the container, while flat channel valves are not positive sealing. A ridge valve provides good sealing but it has a complex structure and is in part a flat channel valve with some of the same shortcomings.

BRIEF SUMMARY OF THE INVENTION

Containers for the storing and dispensing of relatively small volumes of flowable substances can be made inexpensively by thermoforming. However, a problem in the use of containers for other than single dose use is a valve or closure to positively cut off the flow of the flowable substance after a dispensing. Further, in order to avoid inadvertent dispensing the effort to dispense must be one that would not be encountered in the norm al handling of the container. However, the dispensing effort cannot be such as to make it difficult for people with lower hand strength to dispense product from the container. The present container is comprised of a body portion and a valve section. The container is sealed substantially around or periphery. The body portion is comprised of a chamber of essentially any shape with an outlet channel that contains a valve for the dispensing of amounts of a flowable substance. The end of the channel can be sealed by a tear-off tab or an equivalent structure that can be removed to open the outlet channel.

The valve portion is comprised of the channel having a top wall and a bottom wall. The channel can be of essentially any shape and usually will be of a circular or elliptical shape. However it can be polygonal in shape having two, three or more sides. If the channel is circular the upper 180° section will comprise a top wall and the lower 180° section will comprise the bottom wall. This likewise will apply to an elliptical shape where the wall above the major axis will comprise a top wall and below the major axis a bottom wall. Further, in a dispensing channel at a point a set distance from the chamber which holds the substance to be dispensed, either the top or bottom wall will be shaped to be biased in a position to be in close contact with the other wall by being depressed against the other wall during or after the forming of the container. This results in a formed memory of the walls of the valve. By formed memory is meant that the wall that is placed into contact with other walls will have a memory of the shape into which it ha s been formed. When displaced from this shape into which it has been formed by an applied force, such as that caused by a dispensing, the displaced wall will rapidly regain its former shape upon the removal of the applied force. This is the result of the formed memory.

The flowable substance is dispensed from the container by pressing the walls of the chamber together to decrease the volume of the chamber. This forces the flowable substance from the chamber into the channel which comprises the valve. At a given force the valve opens by one channel wall or walls being displaced out of contact with other channel wall or walls. Upon the removal of the force on the chamber, the channel walls again come into intimate contact as a result of the formed memory of one or more of the channel walls and the dispensing of the flowable substance stops.

The containers also can be designed to have a suckback feature. In this way the container will retain its shape after each dispensing. The amount of product will be replaced by air that is drawn into the container part of the container through the valve. The rheology of the product will determine the structure of the container valve and container product chamber in order to get a sufficient suckback. In addition there should be a narrowed region prior to the valve to provide a venturi through which the product and air must flow.

This container with this valve can be used to dispense liquids, gels, lotions, oils, pastes and essentially any flowable substance. The structure of the container can be modified for the needs of a particular substance or the environment in which the container is to be used.

A preferred container is a thermoformed container. The present valve with a formed memory will be at one end of the container. The valve usually will be formed at the same time as the container and will be in the form of a unitary section with the container. The valve is very useful on thermoformed containers since it is an effective way to make a thermoformed container a multidose container. Without an effective valve arrangement thermoformed containers can only be used as single dose containers.

Although thermoformed containers are the preferred containers, containers molded by other techniques can also effectively use the present valve. In these other embodiments the containers and the formed memory valves can be molded as one piece or molded in two or more pieces and assembled.

DETAILED DESCRIPTION OF THE DRAWINGS

Figure 1:
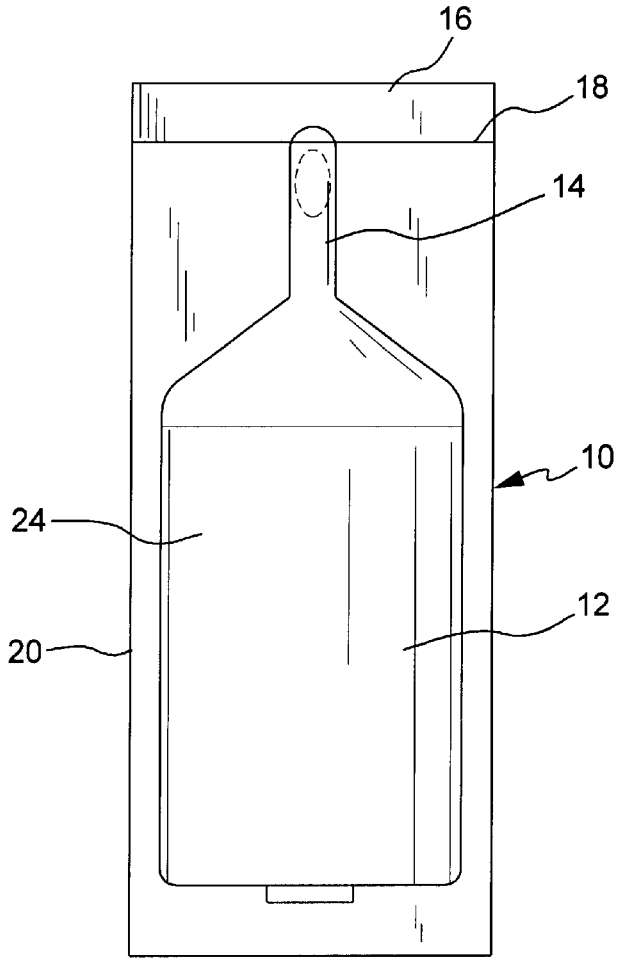
FIG. 1 is a top plan view of an embodiment of a thermoformed container of the present invention.

The preferred embodiment of the present invention will now be described in more detail with reference to the attached drawings and with regard to thermoformed containers. However it is to be understood that the formed memory valve is not restricted to use with thermoformed containers. The shape and size of the containers also can vary as can the shape and size of the components of the containers and yet be within the concept of the present invention.

The thermoformed container 10 of FIGS. 1 to 4 has a flowable substance chamber 12 and a formed memory valve containing portion 14. The periphery 20 of the container is a seal area. Score line 18 is located between seal tab 16 and the remainder of the container. The container 10 is shown in more detail in FIG. 2. The substance chamber 12 has sidewalls 22 and 26 on one side and 23 and 25 on another side connected by transverse walls 24 and 28. The valve containing portion 14 has an upper wall 30 and a lower wall 32 to form a channel. Upper wall 30 tapers downwardly to a close contact with lower wall 32 to provide the formed memory valve. In this particular embodiment the channel of the valve containing portion 14 ends in a deepened area 36 into which the upper wall section 30 fits. However, it is not required that there be a deepened section 36. This may be of the same concavity as the remainder of wall 32. The lower surface of upper wall section 30 has a convex shape and intimately contacts the concave shaped upper surface of lower wall deepened area 36. This contact seals the flowable substance in chamber 12 from being unintentionally dispensed after the removal of seal tab 16. The valve area is shown in more detail in FIGS. 4A and 4B. However, as noted, a deepened region is not required.

Figure 3:
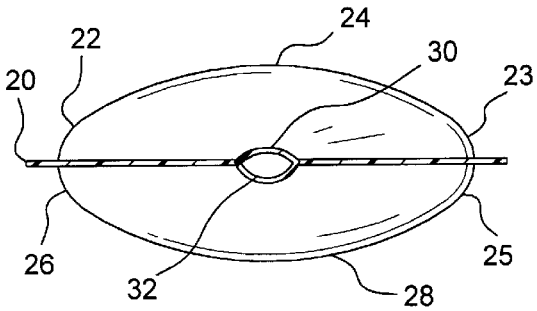
FIG. 3 is a cross-sectional view of the valve of the thermoformed container of FIG. 2 along line 3—3.
Figure 4A:
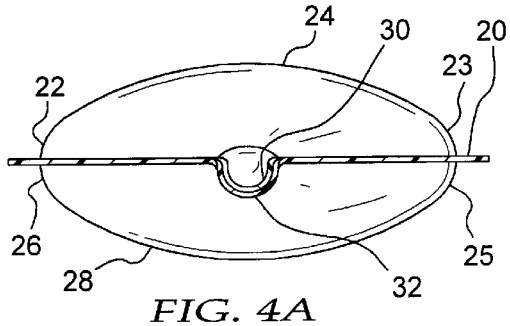
FIG. 4A is a is a cross-sectional view of the valve of the thermoformed container of FIG. 2 along line 4—4.
Figure 4B:
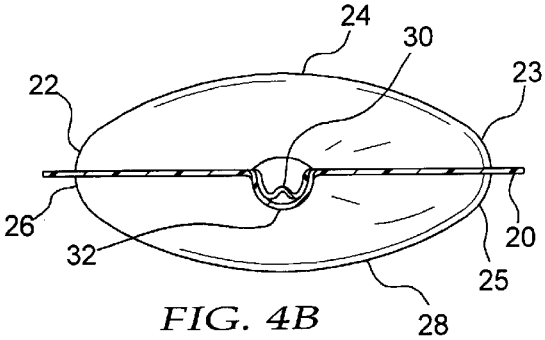
FIG. 4B is a cross-sectional view of the valve of the thermoformed valve of FIG. 4A in an open dispensing mode.

FIG. 3 shows in cross-section the shape of the valve channel 14 prior to the deepened portion 36. This is shown as being elliptical but it can be circular or of a polygonal shape. When polygonal it can have two or more sides. FIGS. 4A and 4B show the valve in one mode of operation. In FIG. 4A the valve is at rest. The valve is closed and there is no dispensing. In FIG. 4B there is a dispensing with part of the upper wall 30 of the valve being forced out of contact with part of the lower wall 32, thus permitting a substance stored in chamber 12 to be dispensed. Upon the cessation of pressure on the chamber 12 the upper wall 32 regains close contact with the lower wall and seals the chamber 12 as a result of the formed memory of the upper wall 30.

Figure 2:
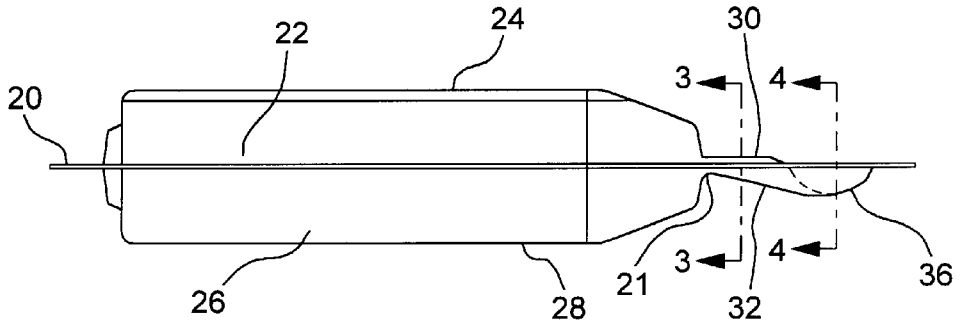
FIG. 2 is a side elevational view of the thermoformed container of FIG. 1.

In FIG. 2 the exit of the relatively wide chamber 12 is a narrow section 21 opening to a wide channel. This wide-narrow-wide flow of substance from the chamber 12 has a venturi effect that promotes the suckback of air through the valve and into the chamber 12 after the dispensing of some of the substance from the chamber 12. In this way chamber 12 will retain its shape after each quantity of the substance is dispensed. This mode of operation is useful for substances that are not affected by the presence of air.

Figure 5A:
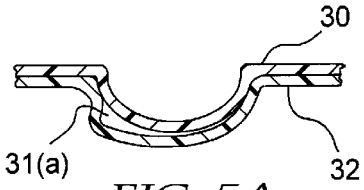
FIG. 5A shows a first alternate embodiment for the opening of the valve of the container of FIG. 1.
Figure 5B:
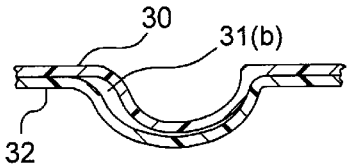
FIG. 5B shows a second alternate embodiment for the opening of the valve of the container of FIG. 1.
Figure 5C:
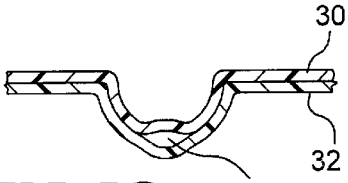
FIG. 5C shows a third alternate embodiment for the opening of the valve of the container of FIG. 1.

FIGS. 5A, 5B and 5C show three modes of operation of the valve of the container 10 of FIG. 1. In FIG. 5A it is shown that the wall 30 gives and creates an opening 31(*a*) upon the application of a dispensing force to the body of the container which holds the substance to be dispensed. In FIG. 5B it is shown that the wall 32 gives and creates an opening 31(*b*) upon the application of a dispensing force to the body which holds the substance to be dispensed. In FIG. 5C it is shown that both the wall 30 and the wall 32 give to create an opening 31(*c*) to dispense the substance in the container portion. The wall or walls that have been stretched and thinned in the making of the valve usually will be the wall to yield upon the application of the dispensing force. However the wall that is not stretched and thinned may also distort to create the opening to provide for the dispensing. In FIGS. 5A, 5B and 5C it is assumed that the thicknesses of the upper wall 30 and the lower wall 32 is the same. However this need not be the case. The wall that has been stretched and thinned may yet not be the thinner wall and consequently it will not be the wall to yield upon the application of a dispensing force to the body of the container. It may initially have been thicker than the other wall. In general the thinner wall of the valve will be the wall to yield in a dispensing mode.

Figure 6:
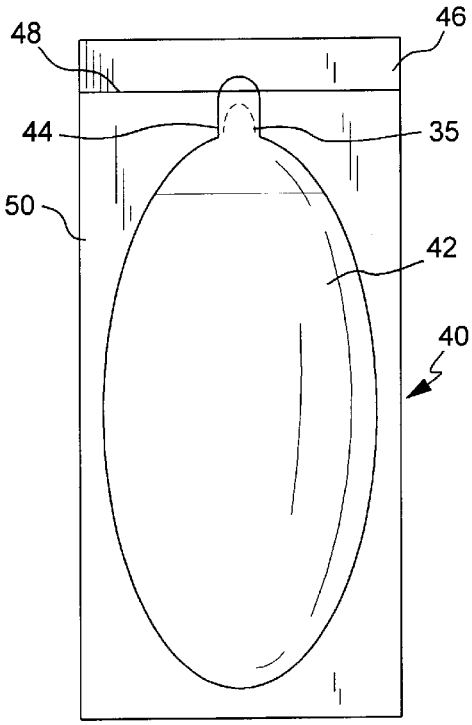
FIG. 6 is a top plan view of the thermoformed container with an elliptical chamber and a shortened valve channel.

FIG. 6 shows an embodiment where the chamber of the thermoformed container is elliptical in shape. This container 40 has body chamber 42 for a flowable substance, a shortened valve portion 44, a seal tab 46 and a score line 48. The periphery 50 of the thermoformed container is a seal area. Also in this embodiment the valve 35 is at the junction of the body chamber 42 and the channel of shortened valve portion 44. Preferably at least half of the valve is in the channel. Most preferably the full valve is in the channel.

Figure 7:
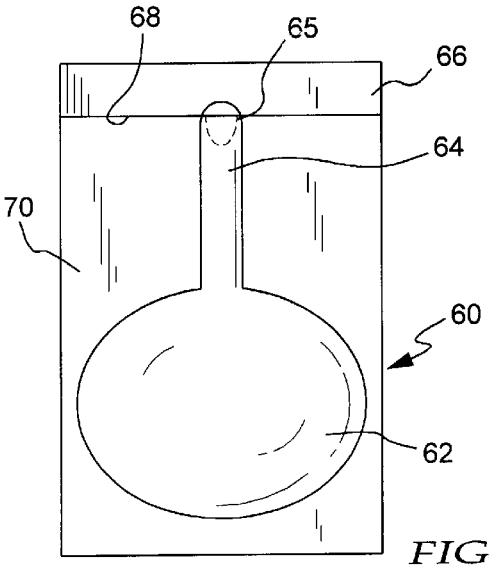
FIG. 7 is a top plan view of the thermoformed container with a circular chamber and an elongated valve channel.

FIG. 7 shows a container 60 with a chamber 62 that is circular in shape and an elongated channel portion 64. Score line 68 separates seal tab 66 from the remainder of the container. The periphery 70 is a seal area. This embodiment shows the valve 65 being located at the junction of the channel and the channel exit. Preferably at least half of the valve is in the channel. Most preferably the full valve is in the channel.

Figure 8:
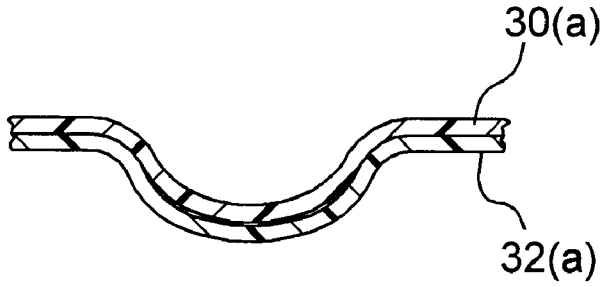
FIG. 8 is a first alternate embodiment of the valve of the container of FIG. 1.
Figure 9:
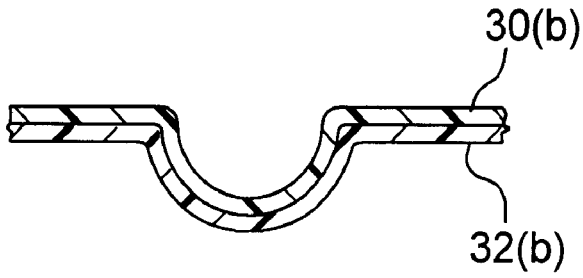
FIG. 9 is a second alternate embodiment of the valve of the container of FIG. 1.
Figure 10:
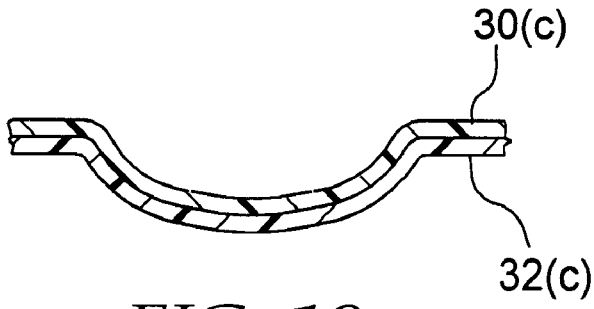
FIG. 10 is a third alternate embodiment of the valve of the container of FIG. 1.
Figure 11:
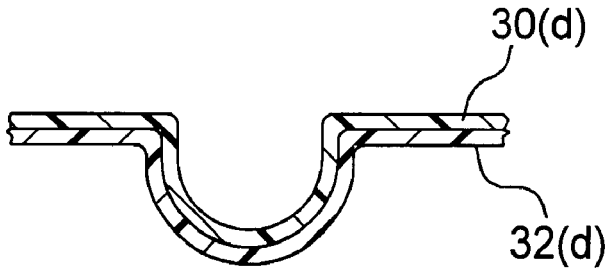
FIG. 11 is a fourth alternate embodiment of the valve of the container of FIG. 1.

FIGS. 8 to 14 disclose several shapes for the valve area of the elongated channel. These can be of a large radius semi-circular channel shape 32(*a*) as shown in FIG. 8, a smaller radius semi-circular shape 32(*b*) of FIG. 9, a hyperbolic shape 32(*c*) in FIG. 10, or a shape 32(*d*) in FIG. 11 that is parabolic. In each of these shapes the upper wall 30(*a*), 30(*b*), 30(*c*), and 30(*d*) of the valve will conform respectively to the shape of the lower surface 32(*a*), 32(*b*), 32(*c*) and 32(*d*) when the valve is closed. However, when a product is to be dispensed, the upper wall 30(*a*), 30(*b*), 30(*c*), and 30(*d*) usually will move out contact with the lower wall by the dispensing force being applied to the container body. Upon a relaxation of the dispensing force the wall 30(*a*), 30(*b*), 30(*c*) and 30(*d*) will ultimately contact the wall 32(*a*), 32(*b*), 32(*c*) and 32(*d*) of the valve and flow of substance from the container body will cease. The upper wall will move since it is the wall with the formed memory.

Figure 12:
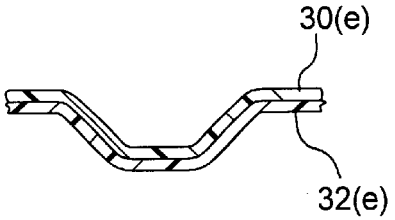
FIG. 12 is a fifth alternate embodiment of the valve of the container of FIG. 1.

FIG. 12 shows a valve that is polygonal in shape. The upper wall 30(*e*) and the lower wall 32(*e*) each have three sides. The valve is shown at rest in FIG. 12 and opened in FIG. 13. Although shown as three sided the valve can have essentially number of sides. As the number of sides increases the shape of the valve approaches a circular shape.

Figure 14:
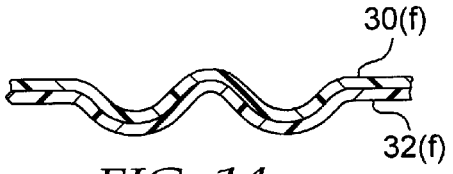
FIG. 14 shows a sixth alternate embodiment of the valve of FIG. 1.
Figure 13:
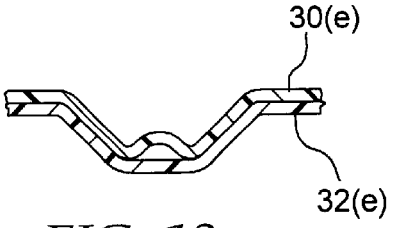
FIG. 13 is the fifth alternate embodiment of the valve of the container of FIG. 1 in an open condition.

FIG. 14 is a cross-sectional view of a valve having a sinusoidal shape. Upper wall 30(*f*) is stretched to contact lower wall 32(*f*). This is an optional structure for the valve.

Figure 15:
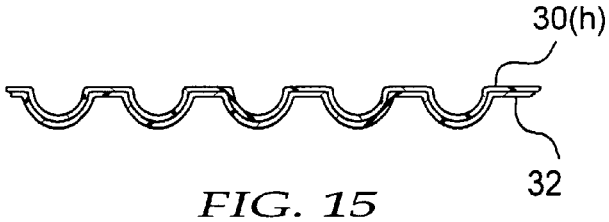
FIG. 15 shows a seventh alternate embodiment of the valve of FIG. 1.

FIG. 15 discloses a valve with a plurality of formed memory portions. This is shown in an enlarged view with the formed memory portions being from less than 25% of the widths as shown to about the width as shown. The formed memory portions also may be of a modified shape such as sinusoidal The upper wall 30(*h*) is formed into a plurality downwardly extending sections and the lower wall a plurality of upwardly extending sections. Each of the extended sections has formed memory. That is, each extended section has been stretched and thinned. On a dispensing, one or more of the extended sections will be dislocated from its formed position. This valve will be useful for dispensing larger volumes of liquids.

Figure 16:
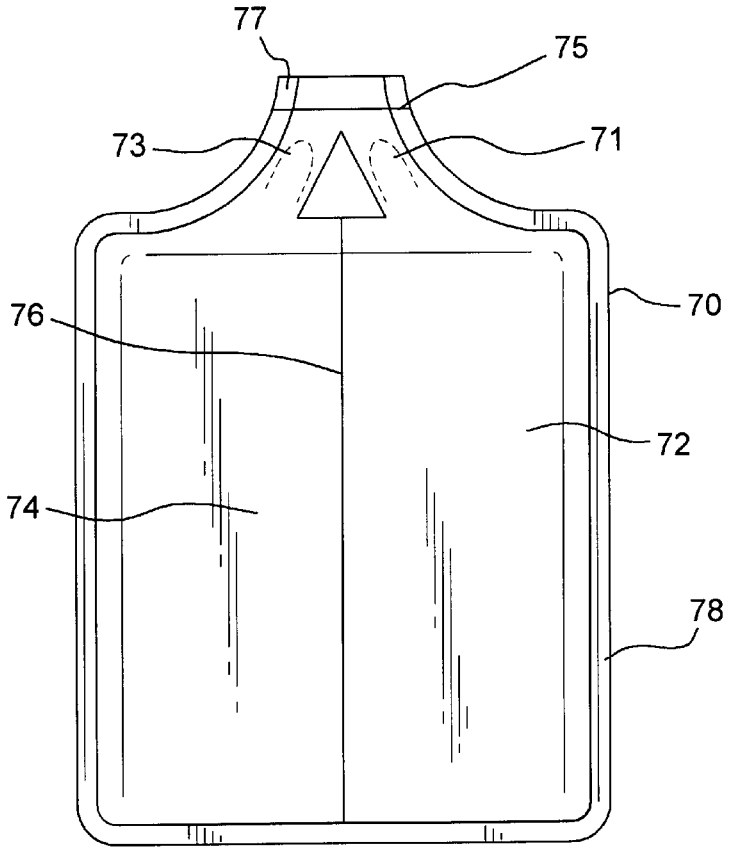
FIG. 16 is an elevational view of a dual chamber container incorporating the present valve.

FIG. 16 shows a dual chamber container 70 with the present valve. The container is sealed along peripheral edge 78. There are two chambers 72 and 74. These chambers are created by sealing the front and rear walls together at a mid-point 76. There are formed two channels 71 and 73. Each channel has a valve which is shown in more detail in FIG. 17. At the end of the channels is seal tab 77 with perforations 75 to facilitate the removal of the seal tab. Each of the valves has upper wall 30 and lower wall 32. The upper wall and the lower wall are sealed together at 79 to maintain the channels separate until the exits of the channels. Since the wall 30 and the wall 32 are of the same thickness the valves will open at substantially the same dispensing pressures. The valve in FIG. 14 also can be used. This is a sinusoidal type valve which can be adapted for the dual chamber container.

Figure 17:
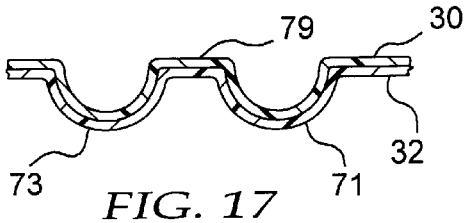
FIG. 17 is a cross-sectional view of the valve of the dual chamber container of FIG. 16.
Figure 18:
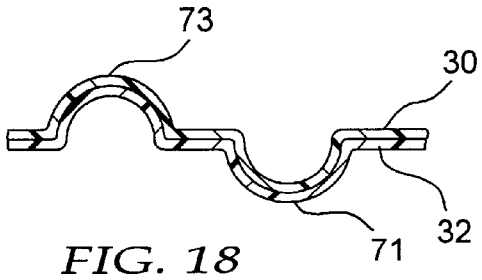
FIG. 18 discloses an alternate valve for the container of FIG. 16.

FIG. 18 discloses an alternate embodiment to the valve of FIG. 17. In this valve the valve is formed where the valves are inverted from channel to channel. In channel 73 the lower wall is stretched and thinned while in channel 71 the upper wall is stretched and thinned. This is a useful valve for a dual chamber container.

Figure 19:
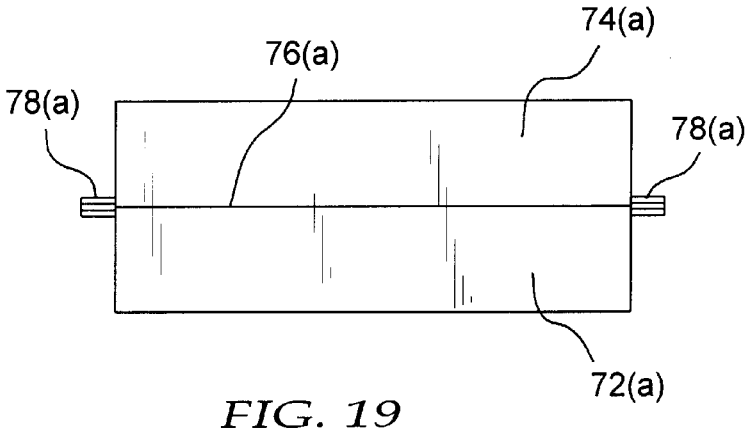
FIG. 19 is a cross-sectional view of an alternate structure for a dual chamber container.
Figure 20:
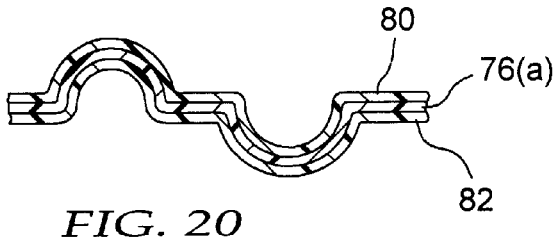
FIG. 20 discloses a valve for the container of FIG. 19.

FIG. 19 shows in cross-section a dual chamber container that differs from that of FIG. 16 in that the divider wall extends from one sidewall to another sidewall rather than from front wall to rear wall. The divider wall 76(*a*) divides the container into chambers 72(*a*) and 74(*a*). The divider wall extends into the peripheral edge 78(*a*) which also is a seal area. FIG. 20 shows a valve for this container. This valve will have three walls comprised of outer walls 80 and 82 and the divider wall 76(*a*). The divider wall usually will be of a reduced thickness in comparison to wall 80 and wall 82. The valve will function in the same manner as the other described formed memory valves. That is, one portion which usually is the most thinned portion will yield and provide for a dispensing.

Figure 21:
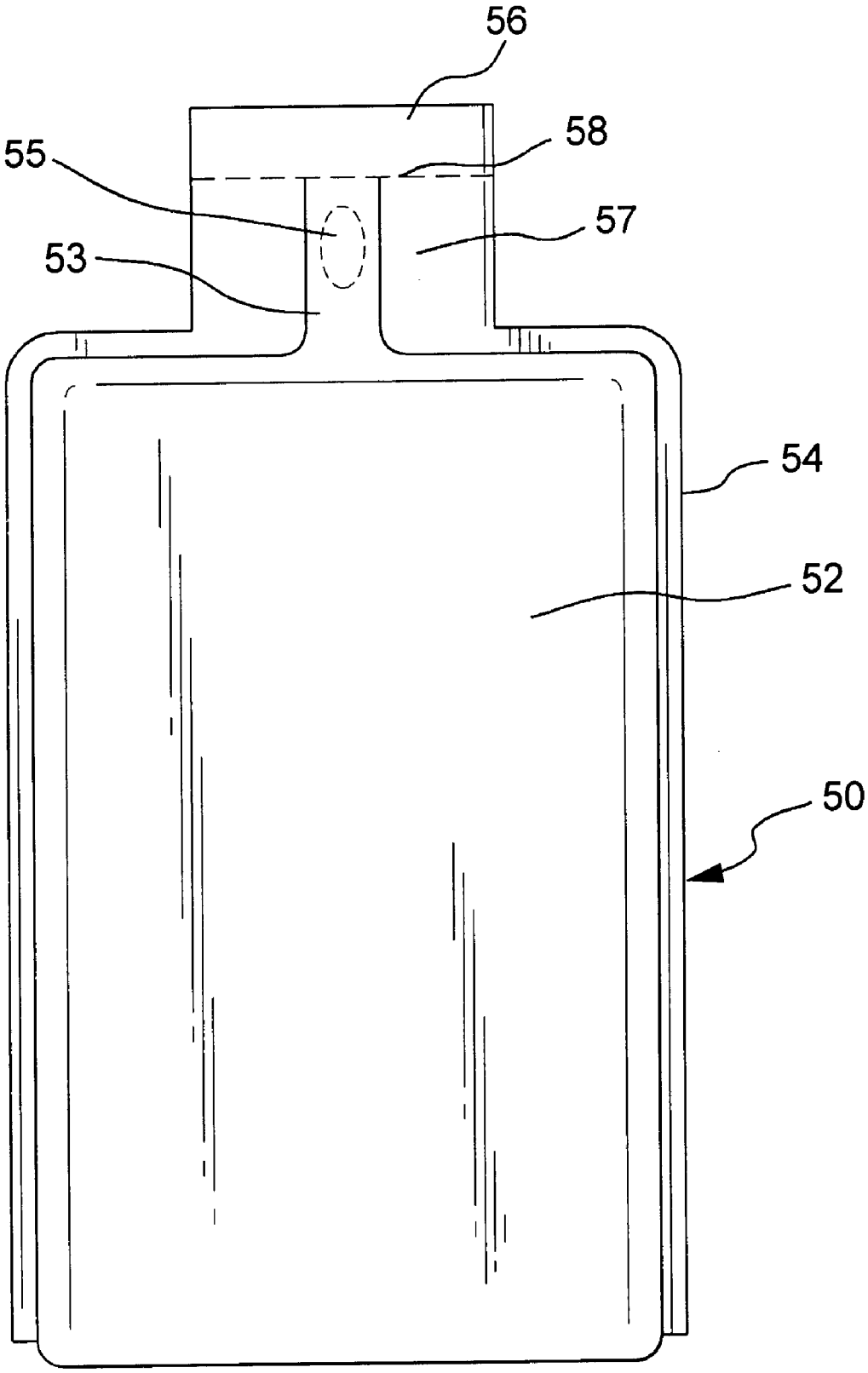
FIG. 21 is an elevational view of a bottle incorporating the present valve.

FIG. 21 shows the present formed memory valve incorporated into a bottle-like container. This container 50 has a product chamber 52 and a sealed edge 54 around the product chamber. At an upper end is a channel 53 with a formed memory valve 55 and a sealed edge 57. Above the valve is breakaway tab 56 separated from the remainder of the container by serrations 58. Breakaway tab 58 is removed for the dispensing of the product from the product chamber 52 and through channel 53. Formed memory valve 55 will regulate the flow of product.

The thermoformed container of FIG. 1 is made by separately thermoforming an upper sheet of film and a lower sheet of film. Each sheet will have a part of the chamber, a part of the elongated channel and formed memory valve portion, the seal tab and the periphery seal area. One sheet in a registered form is overlayed on the other to form the container by heat or adhesively sealing the periphery of the sheets of film. The containers can be filled at the time of forming the containers or in a subsequent operation. The valve is constructed at the same time that the container is made. As the thermoformed upper sheet is being bonded to the thermoformed lower sheet, and while the sheet materials are in a heated condition, one wall of the channel is depressed into a close contact with the other wall. This can be a depressing of the top wall or bottom wall into contact with the other wall. Upon the sheet material of the container cooling it decreases in flexibility and retains an enhanced bias for the shape into which it has been formed, i.e., walls of the channel to remain in a close, intimate contact. This forms the valve of the channel. The upper and lower sheets of plastic that comprise the container can be of the same or different thickness. This thickness can be from about 0.01 mm to about 3 mm, and preferably about 0.2 mm to about 1 mm.

The walls of the channel will have a formed memory to the shape into which they have been formed They will remain in that shape and regain that shape upon any displacement. As noted, the valve wall that has been stretched and thinned usually will be the wall to flex and be displaced during a dispensing.

The valves that have been described can be used on essentially any container. The containers can be made by essentially any molding technique and can be of essentially any shape and contain essentially any number of chambers. The valves can be integral to the container or can be a separate assembly as to the container. There is no limitation in this regard. The concept is to create a formed memory so that one surface of the valve will return to rest in close contact with the other surface after the cessation of a dispensing force.

What is claimed is:

1. A container comprising a substance containing portion and a valve portion, said substance containing portion and said valve portion being sealed substantially around a periphery thereof, said substance containing portion in communication with said valve portion at one end, said valve portion comprising at least one channel having at least one wall and another wall, said one wall being formed with a formed memory portion to be in close contact with said another wall and to remain in said close contact to maintain said at least one channel closed absent a dispensing force applied to said substance containing portion by reducing the volume of said substance containing portion, said formed memory portion of said at least one wall moving into and out of contact with said another wall solely upon the application and release of said dispensing force to dispense said substance from said substance containing portion and to seal said substance within said substance containing portion.

2. A container as in claim 1 wherein at an end of said valve portion distant from said substance containing portion there is a breakaway tab that forms a protective seal prior to an initial use.

3. A container as in claim 1 wherein said valve portion is comprised of a portion of the at least one channel, the at least one channel being of a circular cross-section.

4. A container as in claim 1 wherein said valve portion is comprised of a portion of the at least one channel, the at least one channel being of an elliptical cross-section.

5. A container as in claim 1 wherein said valve portion is comprised of a portion of the at least one channel, the at least one channel being of a polygonal cross-section.

6. A container as in claim 1 wherein said valve portion is comprised of a portion of the at least one channel and is located adjacent to said substance containing portion.

7. A container as in claim 1 wherein said valve portion is comprised of a portion of the at least one channel and is located spaced from said substance containing portion.

8. A container as in claim 1 wherein said valve portion is comprised of a portion of the at least one channel and is located at a junction of said substance containing portion and said valve portion.

9. A container as in claim 1 wherein said valve portion is comprised of a portion of the at least one channel and is located at a junction of the channel and an exit from said at least one channel.

10. A container as in claim 1 wherein at least a portion of said at least one wall and at least a portion of another wall of said valve portion are the same thickness except for the formed memory portion of the one wall, the formed memory portion of said at least a portion of said at least one wall being of a reduced thickness in relation to the at least a portion of said another wall in which it is in a close contact.

11. A container as in claim 1 wherein at least a portion of said at least one wall and at least a portion of said another wall of said valve portion differ in thickness, the formed memory portion of said at least a portion of said at least one wall being of a thickness substantially that of the at least a portion of said another wall in which it is in a close contact.

12. A container as in claim 1 wherein at least a portion of said at least one wall and the at least a portion of said another wall of said valve portion differ in thickness, the portion of the at least a portion of said at least one wall having the formed memory being of a thickness greater than that of the at least a portion of said another wall in which it is in a close contact.

13. A container as in claim 1 wherein a wall of said substance containing chamber at an end opposite said valve portion is substantially planar.

14. A container as in claim 1 wherein the container is a thermoformed container and said container can be supported upright on an end opposite said valve portions.

15. A container as in claim 1 wherein there is a narrowed cross-sectional region at a junction of said substance containing portion and said channel to thereby form a venturi whereby there is created a suckback of air into the substance containing portion after a dispensing of some of the substance from the substance containing portion.

16. A container as in claim 1 wherein said at least a portion of said at least one wall has a concave shape and said at least a portion of said another wall has a convex shape.

17. A container as in claim 1 wherein said container has at least two chambers, each chamber having a valve portion at said one end.

18. A container as in claim 17 wherein the valve portion at said one end of one chamber having an inverted structure with relation to the valve portion at said one end of a second chamber.

19. A container as in claim 1 wherein a plurality of portions of said at least one wall are formed to be in a close mating contact with a plurality of portions of said another wall.

20. A container as in claim 19 wherein said one wall has a plurality of shaped portions.

21. A container as in claim 20 wherein said plurality of shaped portions are concave shaped portions.

22. A container comprising a substance containing portion and a valve portion, said substance containing portion and said valve portion being sealed substantially around a periphery thereof, said substance containing portion in communication with said valve portion at one end, said valve portion comprising at least one channel having at least one wall and another wall, said one wall being formed with a formed memory portion to be in a close contact with said another wall and to remain in said close contact to maintain said at least one channel closed absent a dispensing force applied to said substance containing portion by reducing the volume of said substance containing portion, said formed memory portion of said at least one wall moving into and out of contact with said another wall solely upon the application and release of said dispensing force to dispense said substance from said substance containing portion and to seal said substance within said substance containing portion, at least a portion of one wall having a convex shape and said another wall having a mating concave shape.

* * * * *